United States Patent [19]

Bowker

[11] Patent Number: 4,726,503

[45] Date of Patent: Feb. 23, 1988

[54] MOVABLE ARTIST CANVAS

[76] Inventor: Thomas B. Bowker, 115 Dixboro Rd., Ann Arbor, Mich. 48105

[21] Appl. No.: 764,724

[22] Filed: Aug. 12, 1985

[51] Int. Cl.[4] ..... B65H 20/02; A47F 5/02; A63B 23/04

[52] U.S. Cl. ..... 226/188; 226/190; 248/441.1; 272/73

[58] Field of Search ..... 242/67.1 D; 226/188, 226/189, 190, 194; 280/289 D, 289 R; 248/441.1; 272/73

[56] References Cited

U.S. PATENT DOCUMENTS

| | | | |
|---|---|---|---|
| 755,516 | 11/1903 | Miller | 384/593 |
| 1,525,278 | 2/1925 | Doglione | 272/73 |
| 2,678,821 | 5/1954 | Masterson | 226/188 X |
| 2,788,211 | 4/1957 | Ivanoff | 272/73 |
| 2,894,355 | 7/1959 | Huff | 242/67.1 B |
| 3,195,849 | 7/1965 | Maddox | 248/441.1 |
| 3,544,017 | 12/1970 | Schippers | 226/189 X |
| 3,575,100 | 4/1971 | Krause | 226/189 X |
| 4,239,305 | 12/1980 | Baron | 384/593 |

FOREIGN PATENT DOCUMENTS

| | | | |
|---|---|---|---|
| 909538 | 5/1946 | France | 280/289 D |

*Primary Examiner*—Stuart S. Levy
*Assistant Examiner*—Lynn M. Sohacki
*Attorney, Agent, or Firm*—William M. Hanlon; Andrew R. Basile

[57] ABSTRACT

A participartory device for producing artwork which includes a canvas or other suitable art medium mounted between a plurality of rotatable support posts which extend perpendicularly upward from a base. The rotation of one support post drives the canvas causing a lateral movement of the canvas. The device includes a drive mechanism which, in the preferred embodiment, is a bicycle-like apparatus permanently attached to the base. The rear or drive wheel of the bicycle-like device engages a plate member which extends radially outward from one support post so that pedaling the bicycle-like apparatus causes rotational movement of the support post and lateral movement of the canvas. The individual pedaling the bicycle-like device can apply paint or other drawing media to the moving canvas thereby creating a design on the canvas.

8 Claims, 5 Drawing Figures

MOVABLE ARTIST CANVAS

BACKGROUND OF THE INVENTION

1. Field of the Invention

This invention relates to novelty devices, particularly those which encourage or require user participation. This invention also relates to devices which enable an artist canvas or other medium to move, particularly where the movement is lateral or side-to-side and the means of movement is provided by the user.

2. Description of the Prior Art

Various devices have been proposed to aid in the production of artistic paintings. Such devices include novelty items in which a canvas or cardboard is affixed to a rotating turntable and various colors of paint are applied to the canvas. Centrifugal force urges paint dropped upon the canvas or cardboard outward from the rotational center toward the edges producing an abstract design.

The demand and market for unique novelty devices is well-known. None of the novelty devices of the prior art provide a means whereby an individual user or users can create artistic designs on an artist surface particularly an artist surface which is fashioned as a continuous loop. It is desirable that such a novelty item provide a means whereby various individuals can participate in the creation of the overall pattern and design of the finished artistic expression. It is also desirable that the medium upon which the paint is applied be large enough for the contributions of many individuals and that the canvas be continuously moving to encourage an abstract character of design. It is also desirable that the device be devised so that the individual can control the speed with which the canvas moves.

SUMMARY OF THE INVENTION

There is disclosed herein a unique movable artist canvas for use by an individual artist or by several individuals for the creation of abstract works of art. The device of the present invention is comprised of a canvas or other drawing surface configured as an endless loop mounted between two upstanding rotatable drums such that the rotation of these drums is translated into a lateral movement of the canvas surface. Each rotatable drum is mounted on an upright shaft extending through its center axis. The canvas and drum assembly is held in position by an exterior frame by means of the upright shaft. The lower end of the upright shafts are perpendicularly fixed to a base while the upper ends of the upright shafts are similarly affixed to a corresponding position in an upper member of the exterior frame.

The movable artist canvas device as herein disclosed is supplied with a means for rotating one upright shaft and attached drum about their longitudinal axis which is translated into lateral movement of the canvas. The other upright shaft and drum assembly is freely rotatable to maintain the vertical position of the continuous canvas while permitting its lateral movement. Alternately, both upright shafts and rotatable drums can be provided with rotational drive means.

In another embodiment, the rotation of the drums can be provided by an exterior motor or a manual drive means. In this embodiment, a rotatable disk is mounted on one upright shaft. The rotatable disk is engaged and powered by the drive wheel of a user-operated bicycle-like vehicle permanently mounted onto the base of the movable artist canvas device.

In order to use the device of the present invention. the individual user pedals the bicycle-like device while applying paint to the canvas. The pedaling causes the rotation of the rotatable upstanding drum and movement of the canvas while the user applies paint, pencil, etc. on to the canvas.

BRIEF DESCRIPTION OF THE DRAWING

The various features, advantages and other uses of the present invention will become more apparent by referring to the following detailed description and drawing in which.

DETAILED DESCRIPTION OF THE PREFERRED EMBODIMENTS

Figure 1:
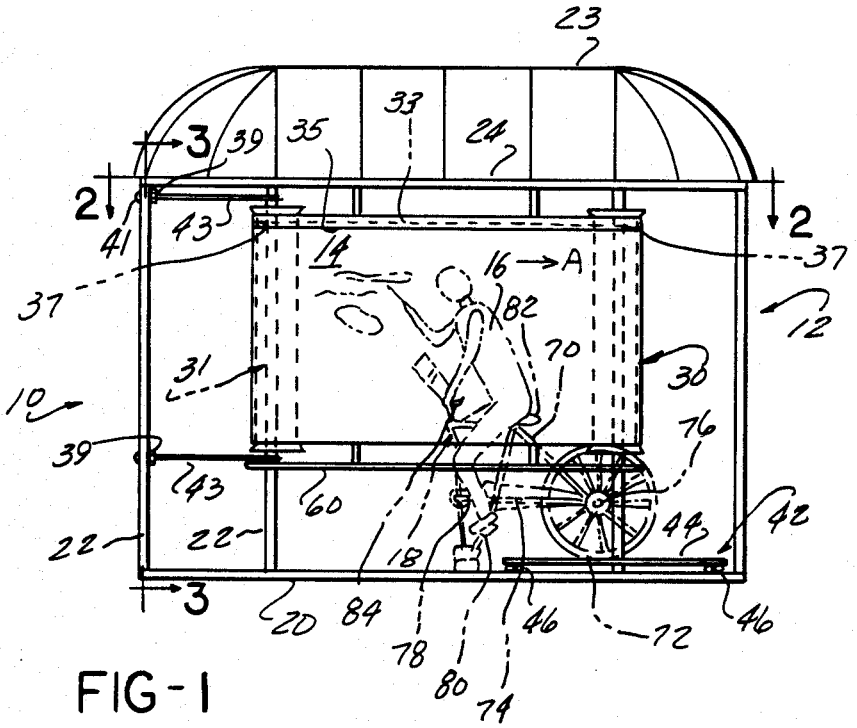
FIG. 1 is a perspective view of a movable artist canavas made according to the teachings of one embodiment of the present invention.
Figure 2:
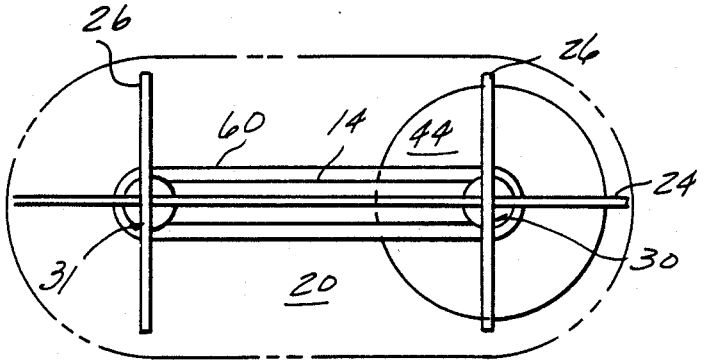
FIG. 2 is a cross sectional view taken along line 2—2 of FIG. 1.
Figure 3:
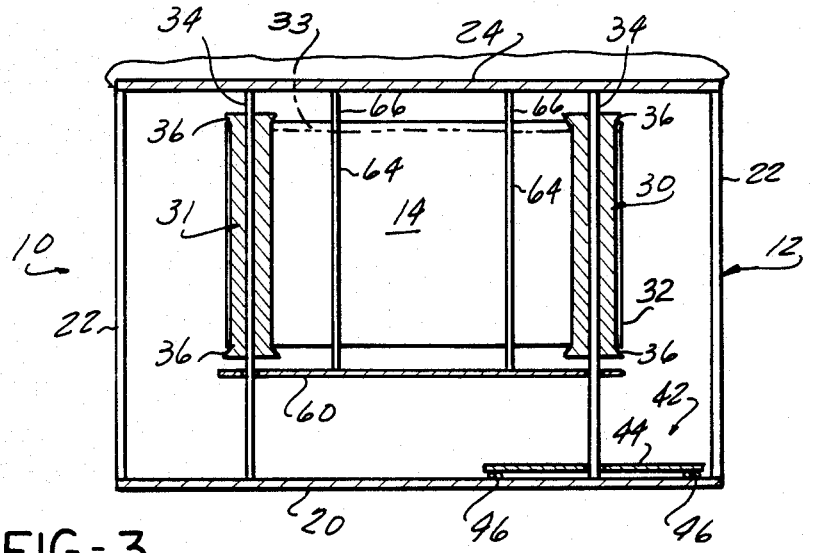
FIG. 3 is a cross-sectional view taken along line 3—3.
Figure 4:
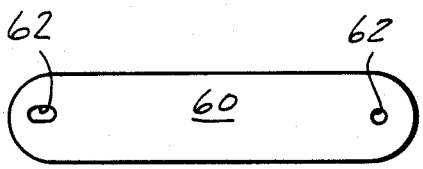
FIG. 4 is an upper view of the drip ledge of the present invention.

Throughout the following description and drawing the same reference number is used to refer to the same component shown in multiple figures of the drawing.

Referring now to the drawing, and to FIG. 1 in particular, there is shown a movable artist canvas apparatus 10 which has an exterior support frame 12. The support frame 12 is of sufficient height to maintain and house a continuous artist canvas 14 as well as the individual user 16 mounted upon a rotational drive means 18 which, as shown, in FIG. 1 is a bicycle-like device which will be described in greater detail subsequently.

The exterior support frame 12 has a base 20 and a plurality of vertically extending support pillars 22 situated along the outer periphery of the base 20. In the preferred embodiment, six vertically extending support pillars 22 are positioned along the base 20 to define an ellipsoidally shaped interior. Two of the vertically extending support pillars 22 are positioned at opposite ends along the major axis of the elliposidally shaped base 20. The remaining four vertically extending support pillars 22 are positioned along the perimeter of the base 20 such that two pair of the vertical support pillars 22 are opposed to one another in a line perpendicular to the major axis through the vertices of the ellipse. A longitudinally extending connecting rod 24 extends along the major axis to connect the two vertically extending support pillars located at either end of the base 20. Two horizontally disposed connecting rods 26 are perpendicularly attached to the top ends of four remaining support pillars 22 to connect the pillars 22 to the longitudinally extending connecting rod 24 at the vertices of the ellipsoid-shaped frame 12. A roof 23 which can be seen most clearly in FIG. 1 may be positioned and attached to the top of the connecting rods 24 and 26.

A canvas 14 or other suitable drawing medium is movably mounted within the support frame 12 on two vertically extending rotatable support posts 30 and 31. Each vertically extending rotatable support post 30 and 31 has an elongated drum 32 positioned concentrically on an upright shaft 34 which extends longitudinally through the center of the drum 32. The upper and lower edges of the drum 32 have an outwardly flaring extension 36 to maintain the canvas 14 in appropriate position. The canvas 14 extends from support post 30 to support post 31 around the respective drums 32 such that movement of one rotatable support post 30 is translated into movement of the canvas 14 and the other support post 31. Thus, the vertically extending rotatable support posts 30 and 31 are held firmly in position maintaining the canvas 14 in a fixed vertical position.

A connecting means, such as a chain 33 is mounted within a hem or folded over portion 35 at the upper end of the canvas 14 and fits within recesses 37 formed in the upper ends of the drums 32 to hold the upper end of the canvas 14 in a fixed position relative to the vertical extent of the drum 32.

Tensioning means 39 in the form of eye-bolts 41 and a cable or robe 43 are connected between one shaft 34 and one end support pillar 22 and opposite ends of one shaft 34 to enable selective tension to be applied to the shaft 34 and the canvas 14 mounted thereabout to compensate for slack or loosening of the canvas 14 during use.

Bearing means can be located in the longitudinally extending connecting rod 24 and in the base 20 at corresponding positions to receive the ends of the upright shafts 34 to position the support posts 30 and 31 and allow them to rotate freely.

Affixed to the upright shaft 34 vertically extending rotatable support post 30 is a rotational drive means 42. In a preferred embodiment, the rotational drive means 42 consists of a circular plate 44 extending radially outward from the upright shaft 34. The circular plate 44 glides on a series of bearing-like wheels 46 in contact with the base 20 permitting free rotation of the circular plate 44 and the vertically extending rotatable support posts 30 attached thereto. The bearing-like wheels 46 may be attached to either the base 20 or the circular plate 44. In the preferred embodiment, the bearing-like wheels 46 are attached to the circular plate 44 by any suitable attachment means. The power source for moving the rotational drive means 42 will be described in greater detail subsequently.

In the preferred embodiment, the movable artist canvas apparatus 10 is also provided with a drip ledge 60. The drip ledge 60 is located below the bottom of the artist canvas 14 and extends perpendicularly outward from the orientation of canvas 14 to collect excess paint or drawing media falling from the canvas 14. In a preferred embodiment, the drip ledge 60 is a planar member having a pair of apertures 62 located adjacent either end of the ledge 60 through which the upright shaft 34 of each support post 30 rotatably extend. The drip ledge 60 is sufficiently large so as to extend outward beyond the lower edge of the canvas 14.

The drip ledge 60 is suspended in position by a pair of rods 64 each sheathed in a hollow sleeve 66. The rods 64 can be attached to the longitudinally extending connecting rod 24 at their upper ends and the drip ledge 60 at their lower ends. Attachment of the rods 64 to both the drip ledge 60 and the longitudinally extending connecting rod 24 can be accomplished by any conventional fastening means. A hollow sleeve 66 is positioned around each rod 64 and remains movable to prevent contact between the rods 64 and the moving canvas 14. In the preferred embodiment, a pair of projections 66 are attached to the longitudinally extending connecting rod 24 extending downward therefrom. The rods 64 are attached to the lower ends of the respective projection 68.

In the preferred embodiment, the power source for moving the plate 44 consists of a bicycle-like device 18. The bicycle-like device 18 includes a frame 70, which is permanently attached to the base 20. A drive wheel 72 is rotatably mounted in the frame 70 such that the drive wheel 72 perpendicularly engages the plate 44. A chain 74 engages the drive wheel 72 at a centrally positioned gear and sprocket mechanism 76. The chain 74 also engages a gear member 78. A pair of pedals 80 are attached to opposed faces of the gear member 78 such that alternating downward force on the pedals 80 rotates the gear member 78 causing movement of the chain 76 and corresponding rotation of the drive wheel 72.

The bicycle-like device has a seat 82 positioned on the frame 70 above the gear member 78. The individual user 16 sits on the seat 82 with his or her feet engaging the pedals 80. The bicycle-like device 18 also has a handle bar 84 on which paint containers 86 are attached.

The drive wheel 72 of the bicycle-like device 18 frictionally engages the upper face of the plate 44. Rotation of drive wheel 72 is converted into radial movement of the plate 44 which, in turn, moves the attached vertically extending rotatable support post 30 causing lateral movement of the canvas 14 in the direction of arrow A of FIG. 1. Thus, by varying the speed at which the pedals are moved will translate into variations in the speed of the movement of the canvas 14. While the user 16 pedals the bicycle-like device 18, he can apply various colors and upward or downward movements of a brush 84 held by the user 16 as the canvas 14 moves result in a variety of designs.

It is also anticipated that a second non-pedalling user could be positioned on the opposite side of the canvas 14 to contribute to the overall design on the canvas 14.

Figure 5:
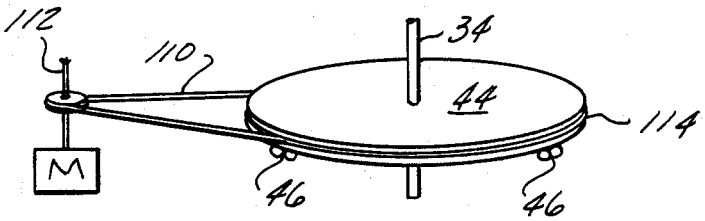
FIG. 5 is a detailed drawing of an alternate drive means of the present invention.

In an alternate embodiment, the movable artist canvas apparatus 10 can be equipped with a motorized rotational drive means to supplement or eliminate user-operated movement of the canvas 14. The movable artist canvas apparatus is equipped with a motor M which supplies the power for rotating the vertically extending rotatable support post 34 as shown in FIG. 5. The motor torque may be translated to rotational movement by means of a belt 110 which connects a motor output shaft 112 with a groove 114 on the periphery of the circular plate member 44. Alternately, the motor torque can be translated from a motor M directly to one of the upright shaft 34 of support post 30 by means of a conventional gear mechanism attached to the upright shaft.

Motorized movement permits the attachment of a conventional a coin operative unit or timer means which will permits the device 10 to be used with a minimal amount of supervision. Additionally, the canvas 14 can be rotated and displayed after the painting has been completed.

What is claimed is:

1. An artist apparatus comprising:

a base;

a plurality of posts rotatably mounted on the base;

an artist surface mounted on the rotatable posts and rotatable therewith, the artist surface formed from an elongated sheet having a first and a second end, the first end attached to the second end to form a continuous loop;

a plate fixedly attached to and extending radially outward from one rotatable post, the plate being proximate to and parallel with the base;

a plurality of rollers located between and in contact with the plate and the base; and a bicycle device mounted on the base and capable of supporting a user the bicycle means including:

(a) a frame permanently attached to the base;

(b) a drive wheel rotatably mounted in the frame perpendicular to the plate and frictionally engaging the plate the drive wheel including a sprocket, a rim and a resilient tire;

(c) a drive gear rotatably mounted on the frame;

(d) a pair of opposed foot pedals attached to the drive gear; and (e) a chain connecting the drive gear with the sprocket to transmit rotation of the drive gear by the foot pedals to the sprocket.

2. The device of claim 1 wherein each rotatable post comprises:

an upright shaft having first and second ends the first end mounted to the base and extending perpendicularly upward therefrom;

an elongated drum concentrically positioned around and mounted on the upright shaft, the elongated drum having flaring extensions extending radially outward at either end and an annular recess positioned proximate to the second end of the upright shaft, wherein the artist surface is carried on the elongated drum between the flaring extensions;

wherein the upright shafts and elongated drums are positioned respective to one another to permit the artist surface to be held therebetween with sufficient tautness so as not to require an underlying support or writing surface.

3. The device of claim 2 wherein the artist surface carried on the elongated drum comprises a protrusion located along one edge of the elongated sheet oriented perpendicular to the first end and the second end, the protrusion adapted to be received within the annular recess on the elongated drum.

4. The device of claim 2 further comprising a support frame, the support frame having a plurality of support pillars fixedly attached to the base and extending perpendicularly upward therefrom; and a plurality of connecting beams attached to the support pillars substantially parallel to the base, wherein the rotatable posts, artist surface, plate and means for rotating the plate are contained within a space defined by the support frame and the base.

5. The device of claim 3 further comprising a drip ledge positioned below the movable artist surface, the drip ledge including:

a planar member; and means for suspending the planar member below the movable artist surface, the suspending means including a plurality of rods attached to the planar member and the connecting beams, the rods extending within the center of the continuous loop of the movable artist surface.

6. The device of claim 3 wherein the means for imparting movement to the artist surface comprises:

a motor;

a rotatable output shaft extending from the motor;

means for connecting the output shaft with one support post for rotating the support post.

7. An artist apparatus comprising:

a base;

a support frame affixed to and extending over the base;

first and second vertically extending posts rotatably mounted between the base and the support frame:

a surface for receiving art media thereon, the surface having a planar sheet form and constructed in a continuous loop, the surface extending around the first and second support posts and rotatable therewith;

a plate secured to and extending outward from one of the rotatable posts, the plate rotatably disposed parallel to the base;

a plurality of rollers located between and in contact with the plate and the base;

a frame for supporting a user mounted on the base;

a drive gear mounted on the frame;

user-operated foot pedals attached to the drive gear;

a drive wheel mounted on the frame and contacting the plate, the drive wheel having a solid rim and a resilient tire in contact with the plate;

a sprocket mounted on the frame and fixedly secured to the drive wheel;

a chain connecting the drive gear and the sprocket to transmit rotation of the drive gear by the foot pedals to rotation of the drive wheel, plate, the one support post and the artist surface.

8. A user-activated device for producing an artistic rendering, the device comprising:

a base having an outer periphery;

a plurality of support pillars fixedly attached to the outer periphery of the base and extending upward therefrom;

a plurality of connecting beams fixedly attached to the support pillars substantially parallel to the base, the support pillars and connecting beams cooperating with the base to define an exterior support frame;

a plurality of rotatable posts mounted within the exterior support frame, the rotatable posts extending from the base to the connecting beams, wherein each rotatable post comprises:

(a) an upright shaft having a first end and a second end, the first and second ends mounted to the base and connecting beams respectively; and (b) an elongated drum having extensions flaring radially outward at either end, the elongated drum concentrically positioned around and mounted on the upright shaft, the elongated drum having an annular recess positioned proximate to the second end of the upright shaft;

an artist surface carried on the elongated drum of each rotatable post, the artist surface formed as an elongated sheet having a first end and a second end, the first end attached to the second end to form a continuous loop, and a continuous means for connection perpendicular to the first end and the second end of the elongated sheet adapted to extend into the annular recess of the elongated drum;

a plate fixedly attached to and extending radially outward from one rotatable post, the plate being adjacent and parallel to the base;

a plurality of rollers located between and in contact with the base and the plate; and means for rotating the plate mounted to the base, the means comprising a bicycle device having:

(a) a frame attached to the base at a position adjacent the artist surface;

(b) a drive wheel assembly rotatably mounted to the frame, the drive wheel assembly having a centrally mounted sprocket and a wheel with a solid rim and a resilient tire;

(c) a drive gear rotatably mounted in the frame;

(d) opposed foot pedals attached to the drive gear; and (e) a chain connecting the drive gear with the sprocket to transmit rotation of the drive gear by the foot pedals to the sprocket.

* * * * *